US008322669B2

(12) United States Patent
Brown

(10) Patent No.: US 8,322,669 B2
(45) Date of Patent: Dec. 4, 2012

(54) STORAGE BIN RETAINER MEMBER

(75) Inventor: Jerrold Brown, Medina, OH (US)

(73) Assignee: Akro-Mils, Inc., Akron, OH (US)

( * ) Notice: Subject to any disclaimer, the term of this patent is extended or adjusted under 35 U.S.C. 154(b) by 178 days.

(21) Appl. No.: 12/827,104

(22) Filed: Jun. 30, 2010

(65) Prior Publication Data

US 2012/0001043 A1 Jan. 5, 2012

(51) Int. Cl.
*A47B 1/00* (2006.01)

(52) U.S. Cl. ..... 248/224.8; 248/222.11; 248/303; 211/94.01; 211/89.01; 24/292

(58) Field of Classification Search ..... None
See application file for complete search history.

(56) References Cited

U.S. PATENT DOCUMENTS

| | | | | |
|---|---|---|---|---|
| 3,045,961 | A * | 7/1962 | Cygan | 248/222.12 |
| 3,229,239 | A | 1/1966 | Modrey | |
| 3,299,839 | A | 1/1967 | Nordbak | |
| 3,477,677 | A | 11/1969 | Hindley | |
| 3,858,988 | A | 1/1975 | Cohen | |
| 4,048,768 | A | 9/1977 | Good | |
| 4,304,382 | A * | 12/1981 | Jelen | 248/220.42 |
| 4,327,888 | A | 5/1982 | Scheneman | |
| 4,341,486 | A | 7/1982 | Hammerschlag | |
| 4,362,285 | A * | 12/1982 | Lewis | 248/220.22 |
| 4,436,355 | A * | 3/1984 | Fortune | 312/270.2 |
| 4,541,598 | A * | 9/1985 | Villanueva et al. | 248/222.12 |
| 4,556,183 | A * | 12/1985 | Greenberger | 248/222.12 |
| 4,735,324 | A * | 4/1988 | Wilcek | 211/184 |
| 4,889,377 | A | 12/1989 | Hughes | |
| 5,022,537 | A | 6/1991 | Henriquez | |
| 5,308,031 | A | 5/1994 | Evenson | |
| 5,377,987 | A * | 1/1995 | Irvin, Jr. | 473/328 |
| 5,494,246 | A | 2/1996 | McCarthy et al. | |
| 5,775,521 | A * | 7/1998 | Tisbo | 211/94.01 |
| 5,788,268 | A * | 8/1998 | Goss et al. | 280/728.2 |
| 6,202,778 | B1 * | 3/2001 | Mistry et al. | 180/69.1 |
| 6,499,608 | B1 * | 12/2002 | Sterling et al. | 211/70.6 |
| 6,811,043 | B2 * | 11/2004 | Perkins et al. | 211/94.01 |
| 7,055,703 | B2 | 6/2006 | Perkins et al. | |
| 7,066,548 | B2 * | 6/2006 | Butler | 297/440.1 |
| 7,281,597 | B2 * | 10/2007 | Pellillo et al. | 180/69.1 |
| 7,527,156 | B2 * | 5/2009 | Wisnoski et al. | 211/70.6 |
| 7,651,146 | B2 * | 1/2010 | Anderson et al. | 296/37.6 |
| 7,686,172 | B2 * | 3/2010 | Wisnoski et al. | 211/94.01 |
| 7,900,781 | B2 * | 3/2011 | Baine et al. | 211/59.1 |
| 8,066,130 | B2 * | 11/2011 | Shaha et al. | 211/90.01 |
| 8,141,724 | B2 * | 3/2012 | Northam et al. | 211/191 |
| 8,220,761 | B2 * | 7/2012 | Brockelsby et al. | 248/224.8 |
| 2008/0296245 | A1 * | 12/2008 | Punzel et al. | 211/153 |
| 2009/0084743 | A1 * | 4/2009 | Spiers et al. | 211/89.01 |
| 2009/0134290 | A1 * | 5/2009 | Begic et al. | 248/222.13 |
| 2009/0145867 | A1 * | 6/2009 | Apgood et al. | 211/94.01 |

* cited by examiner

*Primary Examiner* — Terrell McKinnon
*Assistant Examiner* — Monica Millner
(74) *Attorney, Agent, or Firm* — Mattingly & Malur, P.C.

(57) ABSTRACT

A storage bin retaining member for releasable attachment to a support panel having a pair of horizontally spaced openings includes a body having an upper arm portion extending outwardly from each side thereof, a lower support portion extending outwardly from each side thereof and a central portion connecting the upper arm and the lower support portion. A pair of resilient tabs extending downwardly from the upper ends of the upper arm portion engage a pair of openings in the support panel to secure the retaining member to the support panel and a spring member connected to the bottom of the lower support portion engages a storage bin attached to a lower pair of openings.

6 Claims, 4 Drawing Sheets

STORAGE BIN RETAINER MEMBER

BACKGROUND OF THE INVENTION

1. Field of the Invention

The present invention relates to an improved retaining member and, more particularly, to a storage bin retaining member adapted to retain a storage bin or other article on a support panel using spring pressure.

2. Description of the Related Art

Numerous storage systems comprising a plurality of bins attached to a support panel having spaced openings therein are known in the art. The support panels having storage bins attached thereto may be mounted in moving vehicles such as vans or trucks, may be attached to a wall, may be held between posts or may be supported by other means.

When the support panels are used in an environment involving motion, such as when mounted in a vehicle, storage bins or other article attached to such a support panel may become loose or detached from the support panel. Therefore there is a need for an improved retaining member for releasable attachment to a support panel to securely hold a storage bin or other article on the support panel.

SUMMARY OF THE INVENTION

It is an object of the present invention to provide a retaining member for attachment to a support panel having storage bins or other articles attached thereto wherein the retaining member is a clip which applies spring pressure to a storage bin or other article to retain it on the support panel.

The present invention achieves the above and other objects by providing a retaining member for releasable attachment to a support panel having at least an upper pair of horizontally spaced openings and a lower pair of horizontal spaced openings positioned below the upper pair of horizontal spaced openings. The retaining member includes a body having an upper arm portion extending outwardly from each side thereof, a lower support portion extending outwardly from each side thereof and a central portion connecting said upper arm portion and said lower arm portion. A pair of resilient tabs extend downwardly from outer ends of the upper arm portion with the tabs being flexible backwardly to engage the upper pair of openings and attach the body to the support panel. A spring member is connected to a bottom of the lower support portion to resiliently engage a top portion of a storage bin or other article attached to the lower pair of openings.

Each of the openings of the support panel may have an outwardly and upwardly extending engageable flange attached at a bottom thereof to the support panel and each lower support portion extending outwardly from the side of the body of the retaining member has a top edge which engages a bottom of the flange of each of the upper pair of horizontally spaced openings and wherein the resilient tabs engage the flanges. The central portion of the body of the retaining member has a width which is substantially equal to the width of a space between the upper pair of openings whereby the bin retaining member fits snugly between inner ends of the flanges of the upper pair of openings. The spring member may be a leaf spring and the retaining member may be constructed of plastic or metal.

These, together with other objects and advantages which will be subsequently apparent, reside in the details of construction and operation as more fully described and claimed hereafter, reference being made to the accompanying drawings forming a part hereof, wherein like numerals refer to like parts throughout.

DETAILED DESCRIPTION OF THE PREFERRED EMBODIMENTS

Figure 1:
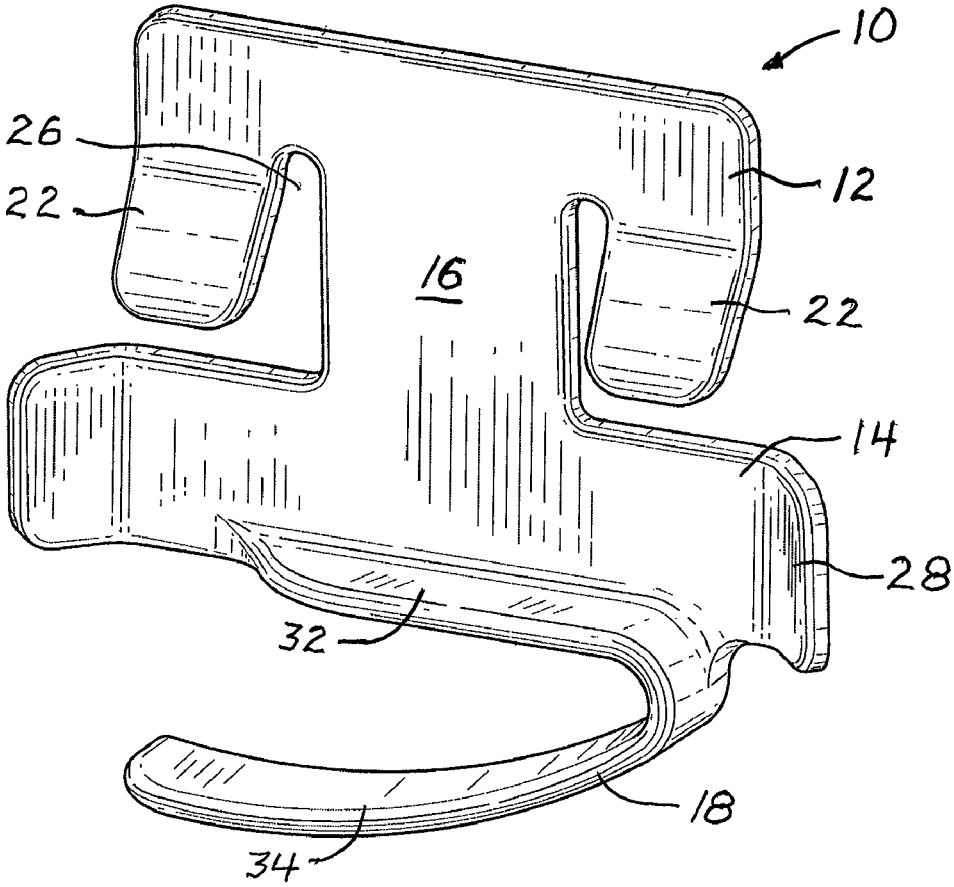
FIG. 1 is a perspective view of a retaining member according to the present invention.

Referring to the drawings, a storage bin or other article retaining member or clip, generally referred to by the numeral 10, is shown which includes a body having an upper arm portion 12 extending outwardly from each side thereof, a lower support portion 14 extending outwardly from each side thereof and a central portion 16 connecting the upper arm portion and the lower support portion. A spring member 18 is attached to a bottom of the lower support portion 16. While a leaf spring is shown in the drawings, other suitable forms of springs may be used such as a round spring or a vertical coil spring.

The retaining member is constructed of either of a metal material such as spring steel or a suitable plastic material such as a high impact polystyrene, acetyl polymer material or a nylon.

Figure 2:
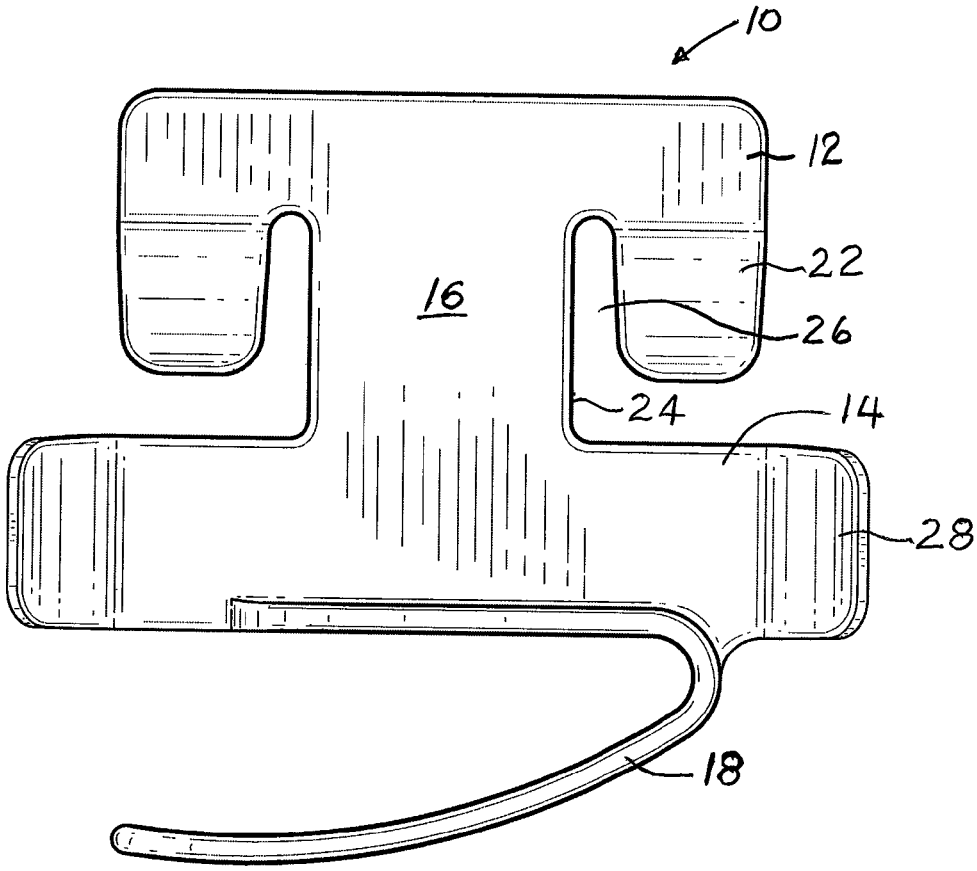
FIG. 2 is a front elevational view of the retaining member of FIG. 1.
Figure 3:
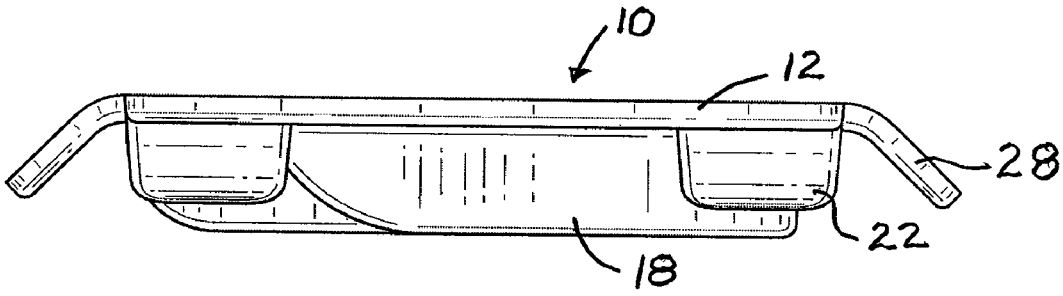
FIG. 3 is a top view of the retaining member of FIG. 1.
Figure 4:
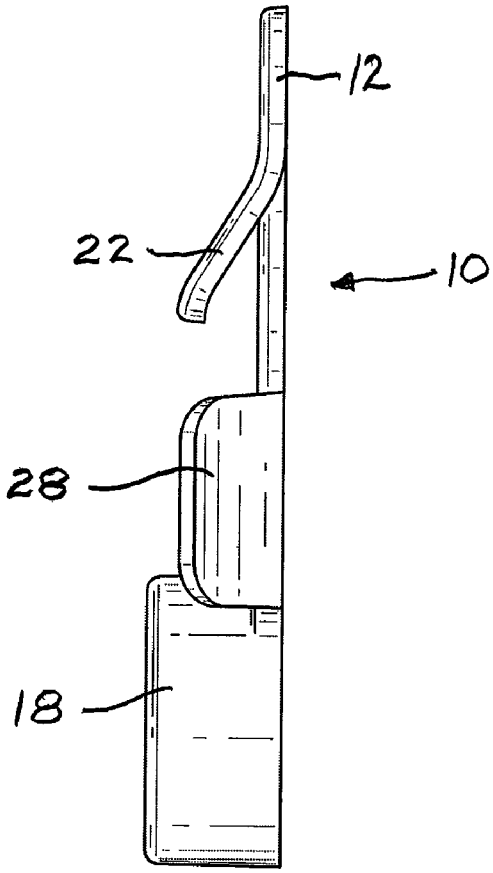
FIG. 4 is a side elevational view of the retaining member of FIG. 1.

The outer ends of upper arm portion 12 each have a tab 22 extending downwardly therefrom which is bent forwardly as shown in FIG. 4. As shown in FIG. 2, the tabs are separated from the straight sides 24 of the central portion 16 of the retaining member by a space 26. The upper arm portion 12 and the tabs 22 are made of a material which is resilient so that the tabs may be flexed backwardly and forwardly.

The lower support portion 14 extends outwardly on each side beyond the outer ends of upper arm portion 12. The outer ends 28 of the lower support portion are bent forwardly whereby they may function as gripping means or handles for grabbing the clip.

The spring member 18 preferably is formed integrally with the bottom of the lower support member 14. The spring member shown in the drawings is a leaf spring member having an upper flange 32 with a flat top surface and a resilient lower leaf spring member 34 attached thereto at one end. While a leaf spring is shown in the drawings, other forms of springs may be used such as a round spring or a vertical coil spring.

Figure 5:
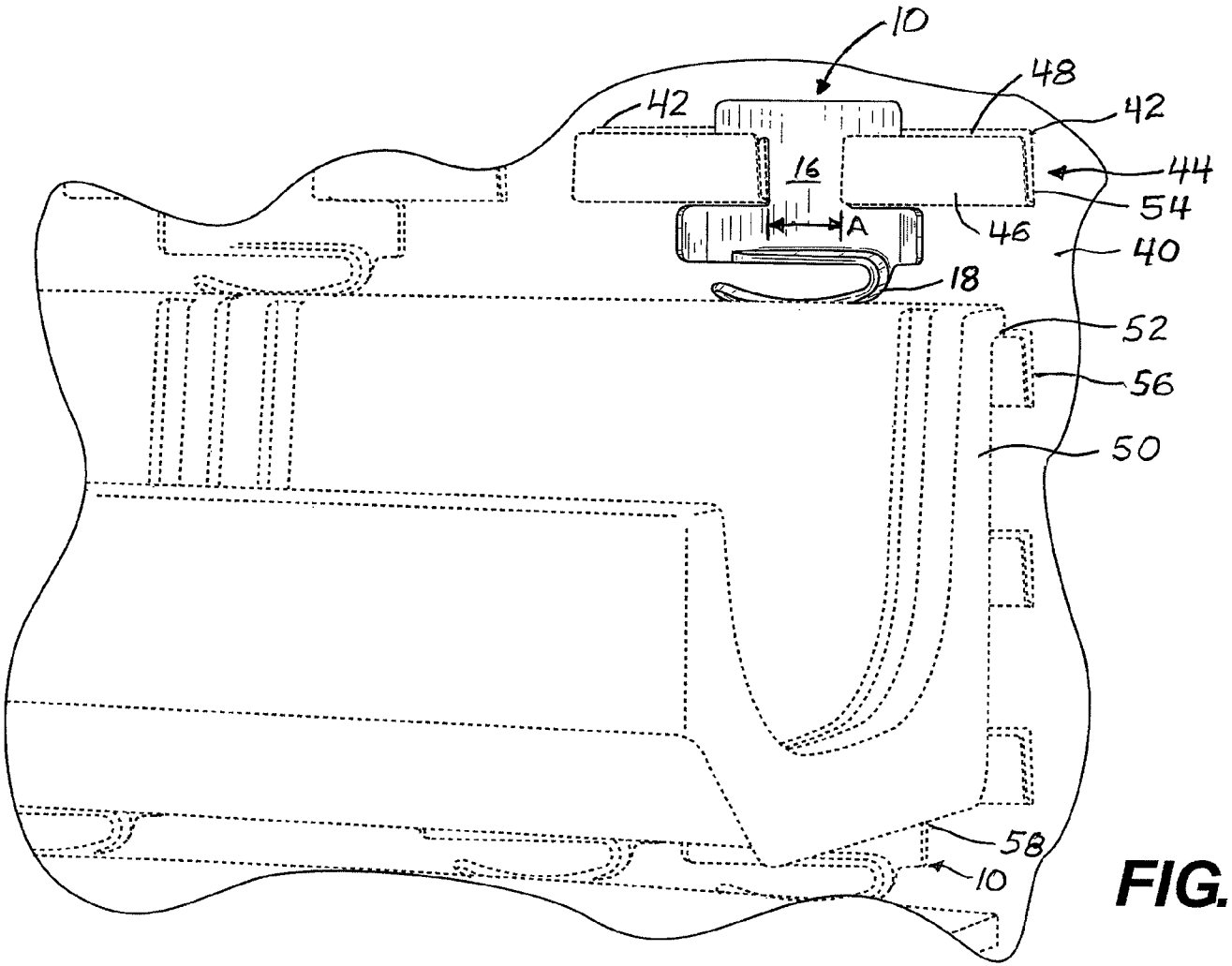
FIG. 5 is a perspective view showing the retaining member of FIG. 1 mounted on a support panel and retaining a storage bin in place which is mounted to openings in the storage panel.

As shown in FIG. 5, the retaining member 10 is releasably attached to a support panel 40 having a plurality of pairs of spaced openings arranged in vertically spaced horizontal rows 44 to form a louvered panel. Each opening 42 has an outwardly and upwardly extending engageable flange 46 attached at a bottom thereof to the support panel so that a gap 48 exists between the flange 46 and the opening 42. The storage panel 40 is adapted to receive and support an article such as storage bin 50 as shown in FIG. 5. The storage bin 50 is provided with a lip 52 which extends up over the top of the flanges 46 and into the gaps 48 of a row 44 of spaced openings

42. The openings 42 are in the form of pairs of spaced openings extending in a horizontal row across the support panel 40.

As shown in FIG. 5, a retaining member 10 is secured to an upper pair 54 of spaced openings in a horizontal row 44 by bending the resilient tabs 22 backwardly and inserting them in the gaps 48 of the openings. The space between the upper pair of spaced openings 54 has a width A. The central portion 16 of the retaining member 10 has a width which is substantially the same as the width A so that the central portion of the body fits snugly between the inner edges and bottom of the flanges 46 of each opening. Due to the resilient tabs 22 being initially bent backwardly and inserted behind the flanges 46, the tabs apply a pressure against the flanges to help secure the retaining member 10 in place.

The storage bin 50 or other article is supported on a lower pair of spaced openings 56 of a lower row of openings 44. When the storage bin is attached to the lower pair of spaced openings and the retaining member is inserted between and attached to the upper pair of spaced openings 54, the spring 18 at the bottom of the retaining member is resiliently pressed against the top edge of the storage bin to securely retain the bin in place on the support panel. Depending on the width of the storage bin or other article, a plurality of retaining members may be utilized to securely retain the storage bin or other article on the storage panel.

When the storage bin is secured to at least one pair of spaced openings, another retaining member 10 is positioned in a pair of spaced openings adjacent the bottom of the storage bin as indicated by the numeral 58 to retain another storage bin mounted to the support panel below the first storage bin.

Numerous other modifications and adaptations of the present invention will be apparent to those skilled in the art and thus, it is intended by the following claims, to cover all such adaptations which fall within the true spirit and scope of the invention.

The invention claimed is:

1. A storage bin retaining member for releasable attachment to a support panel comprising:

a vertically extending central portion having opposed sides defining a first width, an upper end, and a lower end, the central portion being generally planar;

opposed upper arms extending outwardly from the upper end of said central portion, and within the plane of said central portion;

a pair of resilient tabs extending downwardly from outer ends of said upper arms, said tabs being flexible backwardly above the plane of the central portion;

opposed lower arms extending outwardly from the lower end of said central portion, and within the plane of said central portion; and a spring member connected to a bottom of said lower arms to resiliently engage a top portion of a storage bin.

2. A storage bin retaining member according to claim 1 wherein said spring member is a leaf spring.

3. A storage bin retaining member according to claim 1 which is constructed of plastic.

4. A storage bin retaining member according to claim 1 which is constructed of metal.

5. A retaining member for releasable attachment to a support panel comprising:

a planar body portion having left and right opposed edges, an arm portion atop the body portion having outer ends extending outwardly, within the plane of the body portion, from each opposed edge and a leg portion attached beneath the body portion having outer ends extending outwardly, within the plane of the body portion, from each opposed edge;

a pair of resilient tabs extending, toward the leg portion, from said arm, said tabs being flexile above the plane of said body portion; and a spring member attached to a bottom of said leg portion to resiliently engage an article attached to said lower pair of horizontally spaced openings.

6. A retaining member according to claim 5 wherein said spring member is a leaf spring.

* * * * *